US008074593B2

(12) United States Patent
Hansen et al.

(10) Patent No.: US 8,074,593 B2
(45) Date of Patent: Dec. 13, 2011

(54) WATERCRAFT ATTACHMENT DEVICE

(76) Inventors: Jeffrey Hansen, Plymouth, WI (US); Todd Kaminski, Plymouth, WI (US)

( * ) Notice: Subject to any disclaimer, the term of this patent is extended or adjusted under 35 U.S.C. 154(b) by 194 days.

(21) Appl. No.: 12/434,788

(22) Filed: May 4, 2009

(65) Prior Publication Data

US 2009/0272309 A1 Nov. 5, 2009

Related U.S. Application Data

(60) Provisional application No. 61/126,190, filed on May 2, 2008.

(51) Int. Cl.
*B63B 17/00* (2006.01)

(52) U.S. Cl. ..... 114/364

(58) Field of Classification Search ..... 114/343, 114/352, 354, 364
See application file for complete search history.

(56) References Cited

U.S. PATENT DOCUMENTS 2,119,775 A * 6/1938 Chase ..... 114/61.15
3,593,684 A * 7/1971 Cogliano ..... 114/39.28
3,986,219 A * 10/1976 Michowski ..... 114/354
4,621,587 A * 11/1986 Pool ..... 114/39.26
5,174,232 A * 12/1992 Boddy ..... 114/61.25
5,189,974 A * 3/1993 Masters ..... 114/61.15
5,301,623 A * 4/1994 McMillen ..... 114/61.19
5,649,498 A * 7/1997 Zigurs ..... 114/61.24
5,657,713 A * 8/1997 Rowlett ..... 114/61.1

* cited by examiner

*Primary Examiner* — Daniel Venne
(74) *Attorney, Agent, or Firm* — Jerry D. Haynes; The Law Office of Jerry D Haynes

(57) ABSTRACT

The present invention relates to a watercraft attachment device for joining two watercrafts comprising: a pair of parallel tubes, where said parallel tubes are substantially parallel to the watercrafts; a pair of perpendicular tubes, where said perpendicular tubes are substantially perpendicular to the two parallel tubes and adjoin the parallel tubes; four abutting corners, where the four abutting corners are formed by the intersecting tubes; a plurality of hook attachments extending from the each corner, where said hook attachments extend over a lip of each cockpit within the watercrafts to connect the watercrafts to the watercraft attachment device; and at least one tension cord extending from each corner, where said tensioning cords tighten the hook attachments to secure the watercraft attachment device in place.

6 Claims, 3 Drawing Sheets

WATERCRAFT ATTACHMENT DEVICE

CROSS REFERENCE TO RELATED APPLICATIONS

This application claims priority to U.S. Provisional Application Ser. No. 61/126,190 filed on May 2, 2008.

BACKGROUND OF THE INVENTION

1. Field of Invention

The present invention provides an attachment device which temporarily attaches to watercrafts in order to combine the watercrafts into one multi-hull watercraft.

2. Description of Related Art

Many types of watercrafts are popular boats used for fishing, as a tender to a larger vessel, or as a competitive sport. The smaller watercrafts may include kayaks, canoes and dinghies. Some watercrafts of this type may have either a hard or soft shell where the soft shell may be associated with the inflatable type of watercrafts. Because the size of such watercrafts may be limited, a group of people may utilize multiple boats on an outing involving a number of people.

Many smaller watercrafts are single-hulled boats that may be powered by hand paddling or rowing in the case of a rowboat. Users may utilize a single paddle, two paddles used in unison or a paddle per occupant to propel the watercraft through the waterway. Some watercrafts may accommodate two or more people depending on size and configuration. Smaller watercraft however do have some size limitations and thus larger groups of people will need to use multiple watercrafts on outer. On certain occasions where multiple watercrafts are being employed by a group, it may be advantageous to temporarily join two or more watercrafts to form a single multi-hulled watercraft due to water conditions or as desired for other purposes such as fishing.

The prior art includes disclosure of a dual-hulled kayak, U.S. Pat. No. 5,649,498 which discloses two separate kayak hulls that are rigidly joined to form a stiff and flexible structure that is capable of seating two or more persons. The kayak disclosed within the '498 patent includes upright seating across the middle of the joint kayak hulls and the use of row paddles to propel the uniform dual-hulled kayak through a waterway.

U.S. Pat. No. 6,871,608 discloses a dual-hulled watercraft that enables a user to straddle a connector between the hulls in order to navigate the dual-hulled watercraft. In another reference, U.S. Pat. No. 5,189,974, a catamaran kayak is disclosed that includes a plurality of hulls that are joined together and laterally spaced by elongated connectors. The catamaran kayak of the '974 patent includes flexible couplings that are formed on the hulls to receive the ends of the elongated connectors. Similar to the above references, the catamaran kayak is a permanently affixed fixture that allows two or more kayaks to be laterally joined.

Consequently there is a need for a apparatus which could be conveniently attached to two or more separate watercrafts that enables the watercrafts to be joined at least temporarily in order to create a multi-hulled watercraft without having to incorporate permanently affixed coupling and to maintain the original structure in place.

SUMMARY OF THE INVENTION

The present invention relates to a watercraft attachment device for joining at least two watercrafts comprising: a pair of parallel tubes, where said parallel tubes are substantially parallel to the watercrafts; a pair of perpendicular tubes, where said perpendicular tubes are substantially perpendicular to the two parallel tubes and adjoin the parallel tubes; four abutting corners, where the four abutting corners are formed by the intersecting tubes; a plurality of hook attachments extending from the each corner, where said hook attachments extend over a lip of each cockpit within the watercrafts to connect the watercrafts to the watercraft attachment device; and at least one tension cord extending from each corner, where said tensioning cords tighten the hook attachments to secure the watercraft attachment device in place. The four abutting corners firmly abut the outer lip of each respective watercraft and in one particular embodiment are substantially curved. The plurality of hook attachments may include four bungee hook attachments.

DETAILED DESCRIPTION

The present invention provides a watercraft attachment device that enables users to attach two or more watercrafts to create a stable functional watercraft. The watercraft attachment uses a tubular assembly with tension cords that connect it between and onto the watercrafts near the cockpit area. Once secured to the watercrafts, the watercraft attachment device allows the users to form a single multi-hulled watercraft. Also the watercraft attachment device enables the users to disassemble it and to release the attached watercrafts so that they may function as a single watercrafts.

Figure 1:
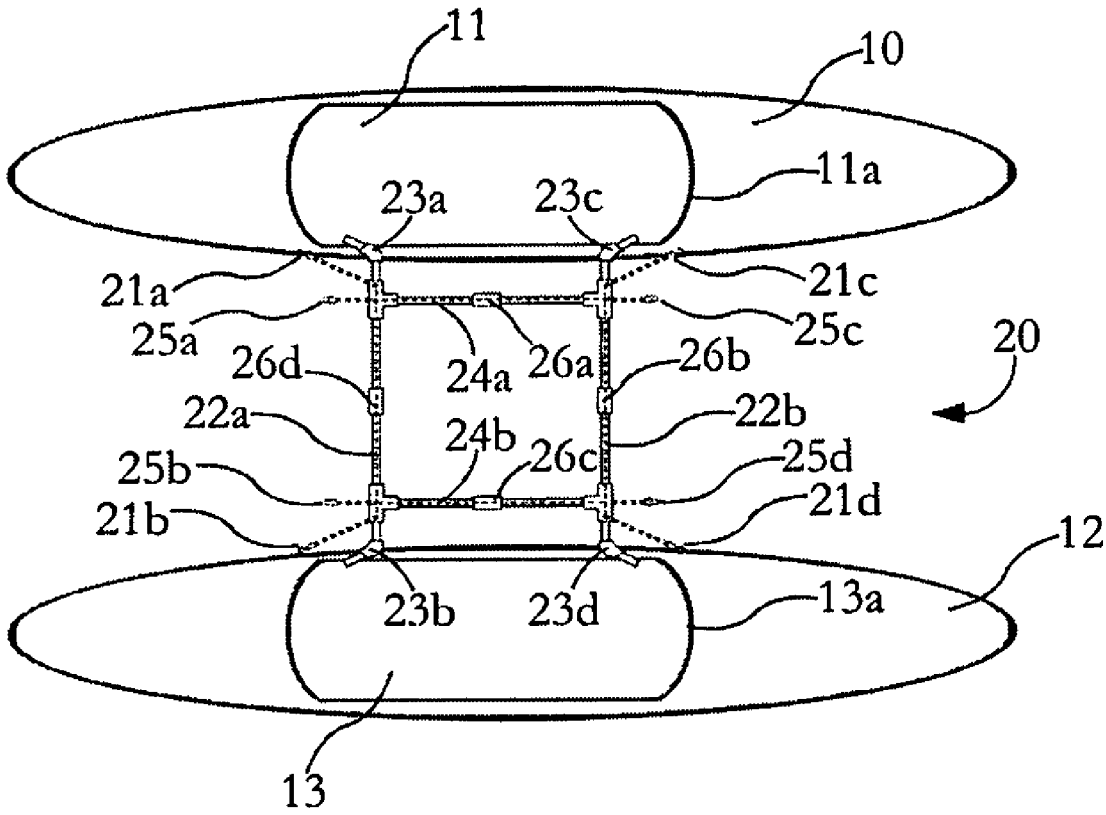
FIG. 1 depicts a top view of the watercraft attachment device according to the present invention adjoining two separate watercrafts.

FIG. 1 provides a top view of the watercraft attachment device 20 according to the present invention. The watercraft attachment device 20 is a substantially rectangular tubular device that includes pull-cord extensions and bungee hook attachments that secure the watercraft attachment device 20 to each individual watercraft. As shown in FIG. 1, the watercraft attachment device 20 joins watercraft 10 and watercraft 12. The tubular frame of the watercraft attachment device 20 includes parallel tubes 24*a*, 24*b* which run parallel to the cockpit of each respective watercraft. The parallel tubes 24*a*, 24*b* are joined to two perpendicular tubes 22*a*, 22*b* and form a substantially rectangular tubular structure. The tubular structure of tubes 24*a*, 24*b* and tube 22*a*, 22*b* includes tensioning cords that extend through the interior of the tubular structure. Four tensioning pull-cords 25*a*, 25*b*, 25*c*, 25*d* are depicted at each corner of the tubular structure. Tubular tension pull-cord 25*a* is depicted in the upper left-hand corner of the tubular structure. Also extending from the tubular structure is a bungee hook attachment 21*a* that attaches to the underside of the inner portion of cockpit 11. Abutting corners 23*a*, 23*c* abut the outer lip of the cockpit and are firmly secure it to the watercraft 10 via bungee hooks 21*a* and 21*c*. Couplers 26*a*, 26*b*, 26*c*, 26*d* join the tubular structure of tubes 24*a*, 24*b* and tube 22*a*, 22*b*. The couplers enable the user to dissemble the attachment device 20 into four segments for easy storage thereof.

On the opposite portion of the tubular construction of the watercraft attachment device 20 are tension pull-cords 25*b*, 25*d*, and bungee hook attachments 21*b* and 21*d*. The bungee hook attachments attach to the under-lip of the cockpit 13 of watercraft 12 and firmly abut the abutting corners 23*b*, 23*d* of the watercraft attachment device 20. The abutting corners 23*b* and 23*d* abut slightly under the lip 13*a* of watercraft 12. The abutting corners 23*a*, 23*c* abut the cockpit lip 11*a* of watercraft 10. Once the respective bungee hook attachments 21 are attached on the inside lip of the respective watercrafts, the tensioning cords 25 are tightened to firmly secure the hooks into place.

Figure 2:
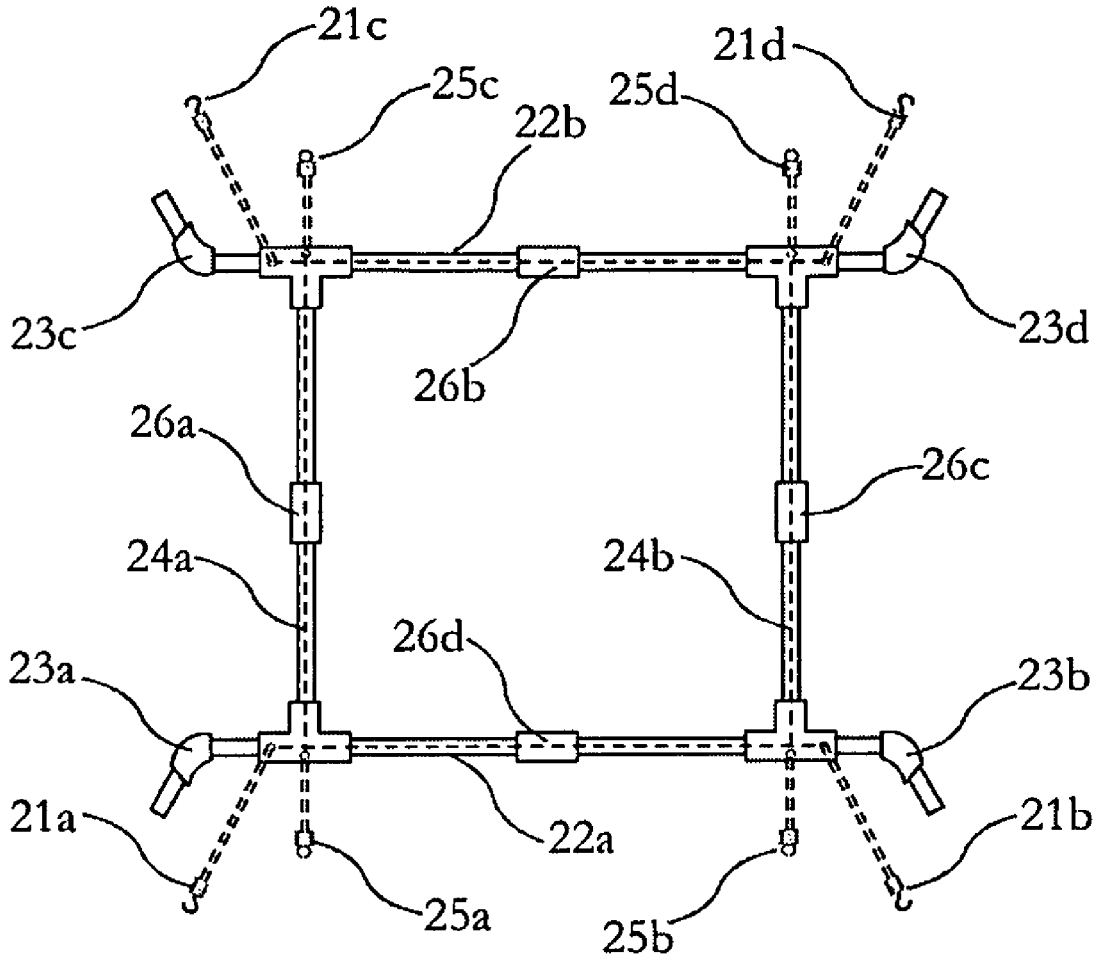
FIG. 2 depicts the watercraft attachment device according to the present invention.

FIG. 2 depicts the watercraft attachment device 20 and provides a top view of the attachment device where all the components are shown as described above with respect to FIG. 1. The watercraft attachment device 20 is shown in its tubular state however a fabric or canvas covering may be attached to the watercraft attachment device 20 that stretches between the open space of the tubular area to provide a surface for placement of items such as cup holders, fishing tackle gear, or actual pockets within the fabric to hold these materials.

Figure 3:
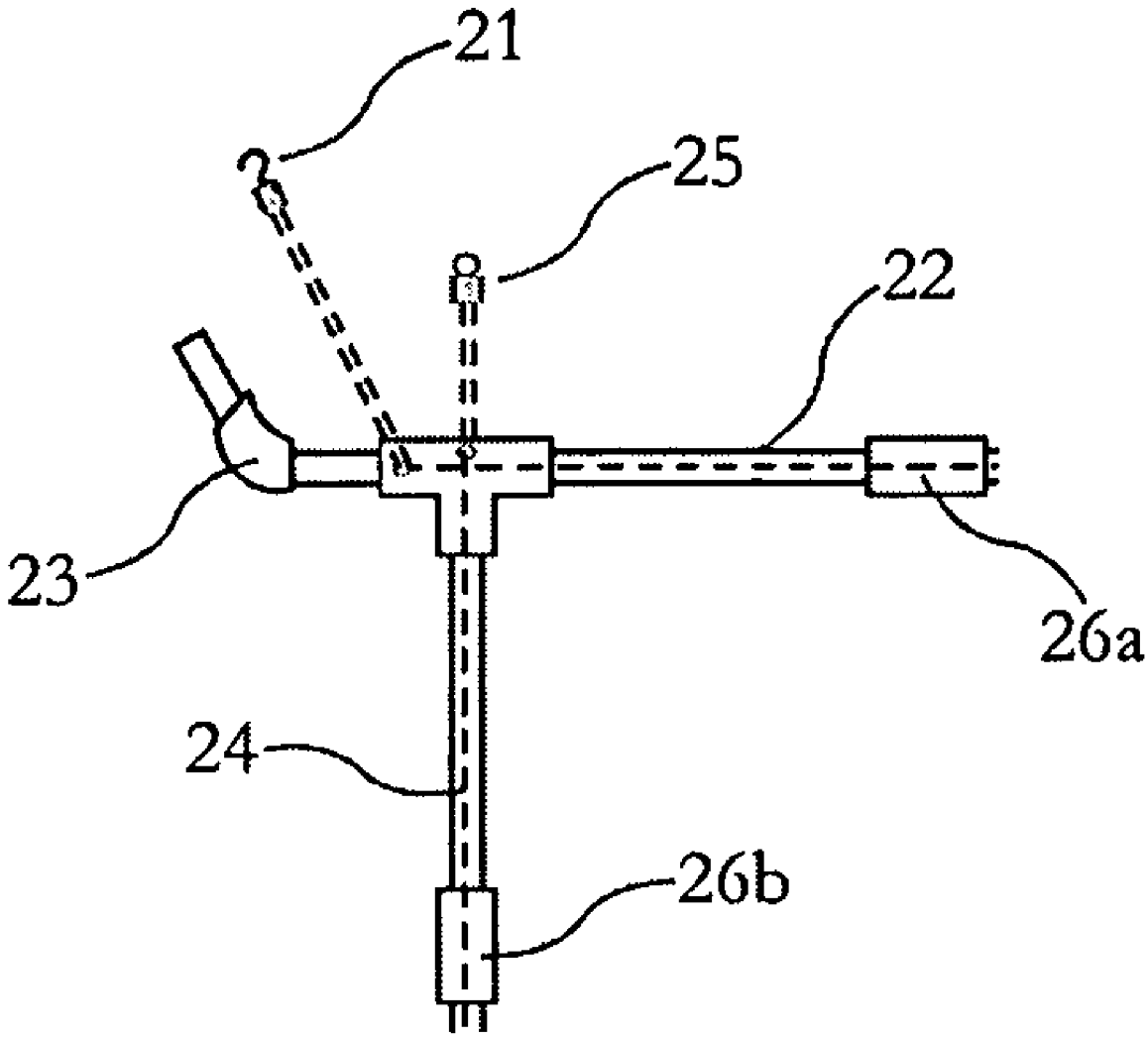
FIG. 3 depicts a corner of the watercraft attachment device according to the present invention.

FIG. 3 provides a detailed view of an exemplary corner of the watercraft attachment device 20. This particular corner shows a bungee hook attachment 21, a pull-tension cord 25 through the tubular extension 22 intersecting with tubular extension 24 and the abutting corner 23. As shown, the watercraft attachment device 20 may be easily detached from the secure position between the two watercrafts and collapsed into four corners for easy storage as depicted in FIG. 3. The couplers 26*a*, 26*b* are depicted that provide a means to assemble and dissemble the attachment device 20. Users therefore could easily assemble and disassemble the watercraft attachment device 20 as desired to provide a temporary connection between two watercrafts.

Other ancillary features of the watercraft attachment device 20 include the implementation of a sail attachment that may be assembled and placed in use in conjunction with the attachment device 20 as an option for users. Other attachments may include a ramp into the water to allow pets enter and exit the water as desired. A small solar powered motor may also be provided as an accessory item. Furthermore, an umbrella assembly may be connected to the attachment device to provide protection from rain or sun. Once the watercraft attachment device 20 is assembled and put in place, it creates a stable and convenient dual-hulled watercraft without any deviation of the basic watercraft shape and structure. The instant invention has been shown and described in what is considered to be the most practical and preferred embodiments. It is recognized, however, that departures may be made there from within the scope of the invention and that obvious modifications will occur to a person skilled in the art.

What is claimed is:

1. A watercraft attachment device for joining at least two watercrafts comprising:

a. a pair of parallel tubes, where said parallel tubes are substantially parallel to cockpits of each watercraft;

b. a pair of perpendicular tubes, where said perpendicular tubes are substantially perpendicular to the two parallel tubes and adjoin the parallel tubes;

c. four corners formed by the intersection of the parallel tubes and the perpendicular tubes, where two corners abut a first watercraft and two corners abut a second watercraft;

d. a plurality of hook attachments extending from the each corner, where said hook attachments extend over a lip of each cockpit within the watercrafts to connect the watercrafts to the watercraft attachment device; and e. at least one tension cord extending from each corner, where said tensioning cords tighten the hook attachments to secure the watercraft attachment device in place.

2. The watercraft attachment device according to claim 1, where said corners firmly abut an outer lip of each respective watercraft.

3. The watercraft attachment device according to claim 2, where the corners are substantially curved.

4. The watercraft attachment device according to claim 1, where the plurality of hook attachment include four bungee hook attachments.

5. The watercraft attachment device according to claim 1, where said watercraft attachment device is collapsible for storage purposes.

6. The watercraft attachment device according to the claim 1, further comprising a fabric that extends over the watercraft attachment device.

* * * * *